US009061348B2

(12) United States Patent
Kikuchi

(10) Patent No.: US 9,061,348 B2
(45) Date of Patent: Jun. 23, 2015

(54) DIE CASTING DEVICE

(75) Inventor: Makoto Kikuchi, Nagoya (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 14/346,137

(22) PCT Filed: Sep. 6, 2012

(86) PCT No.: PCT/IB2012/001712

§ 371 (c)(1),
(2), (4) Date: Mar. 20, 2014

(87) PCT Pub. No.: WO2013/041928

PCT Pub. Date: Mar. 28, 2013

(65) Prior Publication Data

US 2014/0216678 A1 Aug. 7, 2014

(30) Foreign Application Priority Data

Sep. 20, 2011 (JP) ..... 2011-205377

(51) Int. Cl.
*B22D 17/14* (2006.01)
*B22D 17/30* (2006.01)
*B22D 17/04* (2006.01)

(52) U.S. Cl.
CPC ..... *B22D 17/14* (2013.01); *B22D 17/04* (2013.01); *B22D 17/30* (2013.01)

(58) Field of Classification Search
CPC ..... B22D 17/04; B22D 17/14; B22D 17/30
USPC ..... 164/113, 258, 305, 312, 316
See application file for complete search history.

(56) References Cited

U.S. PATENT DOCUMENTS 4,059,143 A * 11/1977 Morita et al. ..... 164/113
4,989,663 A * 2/1991 Kitamura ..... 164/312

(Continued)

FOREIGN PATENT DOCUMENTS

DE 10 2008 057440 5/2010
JP 3-146250 A 6/1991

(Continued)

OTHER PUBLICATIONS

International Search Report Issued Nov. 29, 2012 in PCT/IB12/001712 filed Sep. 6, 2012.

(Continued)

*Primary Examiner* — Kevin E Yoon
(74) *Attorney, Agent, or Firm* — Oblon, McClelland, Maier & Neustadt, L.L.P.

(57) ABSTRACT

A die casting device includes a die including a cavity; an injection sleeve including a feeding orifice; an injection tip provided at the distal end of a support shaft, and configured to be slidable in an axial direction within the injection sleeve by inserting the support shaft into the injection sleeve; a decompression device; a molten-metal holding furnace including a space to store molten metal; a pump pumping up the molten metal from the molten-metal holding furnace; and a feeding pipe including a first end connected to the pump and a second end. The feeding pipe is joined to the injection sleeve through a relay pipe including a vibration absorption portion, the molten metal is fed into the injection sleeve from the molten-metal holding furnace through the feeding pipe by the pump, and is pushed out of the injection sleeve by the injection tip, and the molten metal is injected into the cavity decompressed by the decompression device.

10 Claims, 3 Drawing Sheets

(56) References Cited

U.S. PATENT DOCUMENTS

| | | | | |
|---|---|---|---|---|
| 6,953,079 | B2 * | 10/2005 | Suzuki et al. | 164/267 |
| 2004/0191097 | A1 * | 9/2004 | Nakagawa et al. | 417/454 |
| 2006/0042772 | A1 | 3/2006 | Fujikawa | |

FOREIGN PATENT DOCUMENTS

| | | | |
|---|---|---|---|
| JP | 04-258357 | | 9/1992 |
| JP | 5-28547 | U | 4/1993 |
| JP | 9-323143 | A | 12/1997 |
| JP | 10-231971 | A | 9/1998 |
| JP | 10-244354 | A | 9/1998 |
| JP | 2002-137051 | A | 5/2002 |
| JP | 2002-239708 | | 8/2002 |
| JP | 2002-239709 | | 8/2002 |
| JP | 2003-245768 | | 9/2003 |
| JP | 2004-154825 | | 6/2004 |
| JP | 2004-167499 | | 6/2004 |
| JP | 3620476 | | 2/2005 |
| JP | 3854942 | | 12/2006 |

OTHER PUBLICATIONS

Office Action issued Jan. 20, 2015 in Japanese Patent Application No. 2011-205377 (partial English translation only).

* cited by examiner

DIE CASTING DEVICE

BACKGROUND OF THE INVENTION

1. Field of the Invention

The present invention relates to a die casting device, specifically to a die casting technique, in which the cavity of a die is decompressed to conduct casting.

2. Description of Related Art

In conventional die casting, the following techniques are used, namely: feeding a predetermined amount of molten metal into an injection sleeve having a feeding orifice; after the feeding, moving an injection tip by drive means at a predetermined timing; and injecting the molten metal from the injection sleeve into the cavity of a die at high pressure (For example, refer to Japanese Patent Application Publication No. 2003-245768 (JP 2003-245768 A), Japanese Patent Application Publication No. 4-258357 (JP 4-258357 A), Japanese Patent Application Publication No. 2002-239708 (JP 2002-239708 A), and Japanese Patent Application Publication No. 2004-167499 (JP 2004-167499 A)).

In the die casting device disclosed in JP 2003-245768 A, molten metal is taken out of a molten-metal holding furnace by a ladle, and it is fed into the feeding orifice of an injection sleeve by the ladle.

However, in the configuration disclosed in JP 2003-245768 A, as it is difficult to adjust the amount of ladled molten metal, it is difficult to improve the feeding accuracy. In addition, as molten metal touches the atmosphere at the time of feeding from the ladle into the sleeve, there are problems that the temperature of the molten metal decreases, and/or the product quality deteriorates due to gas such as dissolved hydrogen and an oxidized film produced in the molten metal.

On the other hand, the die casting devices disclosed in the above mentioned JP 4-258357 A and JP 2002-239708 A are configured in a manner that a feeding pipe and a feeding orifice of the injection sleeve are directly joined together, and molten metal is fed through the feeding pipe in order to avoid the molten metal from touching the atmosphere.

However, because the injection sleeve is fed with molten metal of high temperature, deformation is incurred in the injection sleeve due to the heat of the molten metal, which tends to cause vibrations at the time of injection. In the configurations disclosed in JP 4-258357 A and JP 2002-239708 A, there are problems that the feeding pipe directly joined to the injection sleeve, and/or its junction are damaged due to abrasion and/or vibration at the time of injection.

In addition, the die cast device disclosed in JP 2004-167499 A is configured in a manner that a cover is provided between a feeding pipe and a feeding orifice of the injection sleeve so as to avoid molten metal from touching the atmosphere at the time of molten-metal feeding.

However, according to the technique disclosed in JP 2004-167499 A, the feeding pipe is not directly joined to the injection sleeve, and thus a separate structure for supporting the feeding pipe is required. In addition, there is a possibility that the strength of the cover is insufficient with respect to the heat of the molten metal at the time of molten-metal feeding and/or the pressure at the time of decompressing a cavity, and that the cover is damaged.

SUMMARY OF THE INVENTION

The present invention provides a die casting device that can maintain, with a simple configuration, the quality of casting products, the accuracy of molten-metal feeding into the injection sleeve, and the durability of the die casting device, and also reduce the effect of abrasion and vibration at the time of injection.

An embodiment of the present invention is a die casting device including: a die that includes a cavity; an injection sleeve that includes a feeding orifice and communicates with the cavity; a support shaft; an injection tip that is provided at the distal end of a support shaft. The injection tip is configured to be slidable in an axial direction within the injection sleeve by inserting the support shaft into the injection sleeve. Further, the die casting device includes a decompression device that communicates with the cavity; a molten-metal holding furnace that includes a space to store molten metal; a pump that pumps up the molten metal from the molten-metal holding furnace; and a feeding pipe that includes a first end connected to the pump and a second end that communicates with the feeding orifice. The feeding pipe is joined to the injection sleeve through a relay pipe that includes a vibration absorption portion. The molten metal is fed into the injection sleeve from the molten-metal holding furnace through the feeding pipe by the pump. The fed molten metal is pushed out of the injection sleeve by the injection tip so that the molten metal is injected into the cavity decompressed by the decompression device, thereby casting is conducted.

The first end of the relay pipe may be joined to an intermediate portion of the feeding pipe, and the second end of the feeding pipe may be positioned in or near the feeding orifice.

The second end of the feeding pipe may be bent in an injection direction of the molten metal.

The relay pipe may be connected to the injection sleeve through a thermal insulation member.

The molten-metal holding furnace may store the molten metal in a state that the molten metal is insolated from the atmosphere.

The die casting device of the present invention can maintain, with a simple configuration, the quality of casting products, the accuracy of molten-metal feeding into the injection sleeve, and the durability of the die casting device, and also reduce the effect of abrasion and vibration at the time of injection.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

It should be noted that the scope of the invention is not limited to the following embodiment but broadly contains the whole technical idea that is described in this specification and the drawings.

The die casting device 30 according to one embodiment of the present invention will be described with reference to FIG. 1. In this specification, descriptions will be made in a manner that the direction from the left side to the right side (from the left side to the right side of the die casting device 30) and the direction from the right side to the left side in FIG. 1 are referred to as "right side direction" and "left side direction", respectively.

Figure 1:
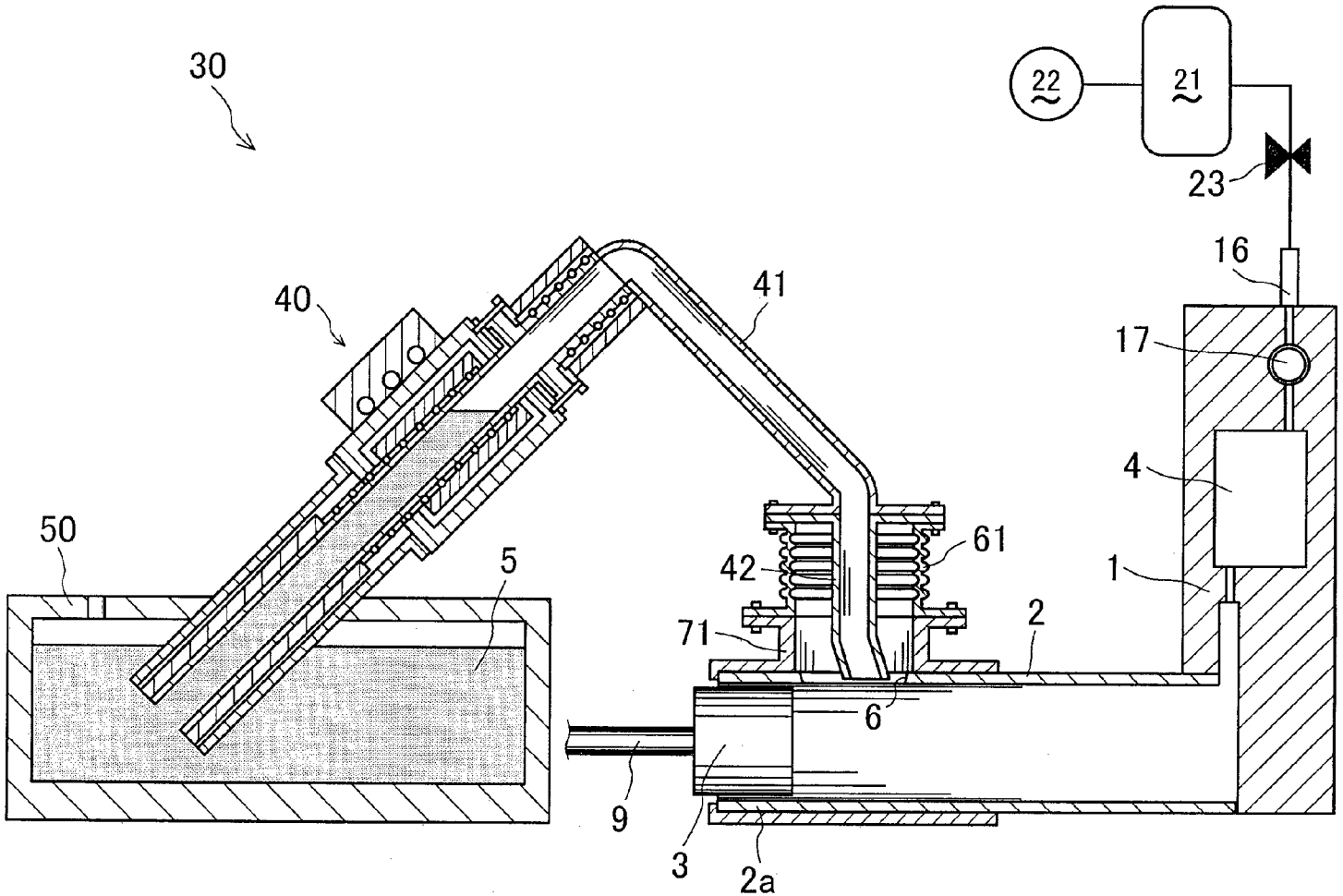
FIG. 1 is a schematic sectional view of a die casting device according to one embodiment.

As shown in FIG. 1, a die 1 of the die casting device 30 has a cavity 4 formed therein, and an injection sleeve 2 having a substantially cylindrical shape is attached to the die 1 in a manner to be projected leftward from the die 1 and to communicate with the cavity 4. In the injection sleeve 2, an injection tip 3 having a short cylindrical shape is slid rightward to push out molten metal 5 such as aluminum fed into the injection sleeve 2, to inject the molten metal 5 into the cavity 4.

The injection sleeve 2 has a feeding orifice 6, through which molten metal 5 is fed into the injection sleeve 2 through the feeding pipe 41, 42, which will be described later. The support shaft 9 is inserted into the injection sleeve 2 and controlled by an actuator (not shown) composed of an air cylinder, hydraulic cylinder or the like, to move forward and backward. The injection tip 3 provided at the distal end of the support shaft 9 slides within the injection sleeve 2 in the axial direction.

The die 1 is provided with a suction port 16 for suctioning air from the cavity 4. In addition, a shut valve 17 is provided in a passage connecting between the cavity 4 and the suction port 16. By connecting the suction port 16 to a decompression device (a decompression tank 21 and a vacuum pump 22 in this embodiment), the decompression device communicates with the inside of the cavity 4. A valve 23 is provided in the passage between the decompression tank 21 and the suction port 16 to open and close the passage. Decompression of the cavity 4 is started by opening the valve 23 of the passage in conjunction with injection control.

The die casting device 30 includes: an molten-metal holding furnace 50, which stores molten metal 5 therein; and an electromagnetic pump 40, of which one end is inserted into the molten metal 5 in the molten-metal holding furnace 50 at an angle of about 45 degrees, to pump up the molten metal 5 from the molten-metal holding furnace 50. The inner surface of the electromagnetic pump 40 is made of ceramic, and the electromagnetic pump 40 pumps up the molten metal 5 by an electromagnetic force by applying a voltage to a built-in coil in conjunction with injection control. In this embodiment, although the electromagnetic pump 40 is used as a pump, other pumps such as a positive displacement pump and a turbopump using a rotor may be used. In addition, in this embodiment, the molten-metal holding furnace 50 stores the molten metal 5 in a state that the molten metal 5 is isolated from the atmosphere.

In addition, the die casting device 30 includes the feeding pipe 41, 42 made of ceramic. The feeding pipe 41, 42 have an upper end connected to the electromagnetic pump 40 and a lower end communicating with the feeding orifice 6. More specifically, the feeding pipe 41, 42 is configured by joining the upper feeding pipe 41 and the lower feeding pipe 42 (hereinafter, the upper feeding pipe 41 and the lower feeding pipe 42 are collectively referred to as feeding pipe 41, 42) together. The upper feeding pipe 41 is arranged such that its upper end is connected to the upper end of the electromagnetic pump 40, and inclined toward the injection sleeve 2. Furthermore, the upper end of the lower feeding pipe 42 is arranged so as to be connected to the lower end of the upper feeding pipe 41, and the lower end of the lower feeding pipe 42 is arranged so as to be perpendicular to the feeding orifice 6.

The feeding pipe 41, 42 are joined to an injection sleeve 2 through a relay pipe 61 having a bellows 61*c* of a bellows structure, which is a vibration absorption portion. Specifically, the injection sleeve 2 is connected to a thermal insulation member 71 made of metal or ceramic, and formed in a tubular shape communicating with the feeding orifice 6. That is, the relay pipe 61 is connected to the injection sleeve 2 through the thermal insulation member 71.

Furthermore, the relay pipe 61 is connected to the upper side of the thermal insulation member 71, and this relay pipe 61 supports the junction of the upper feeding pipe 41 and the lower feeding pipe 42. That is, the upper end of the relay pipe 61 is joined to the junction of the upper feeding pipe 41 and the lower feeding pipe 42 (which is an intermediate portion of the feeding pipe 41, 42), and the lower end of the lower feeding pipe 42 is positioned in or near the feeding orifice 6.

Figure 2:
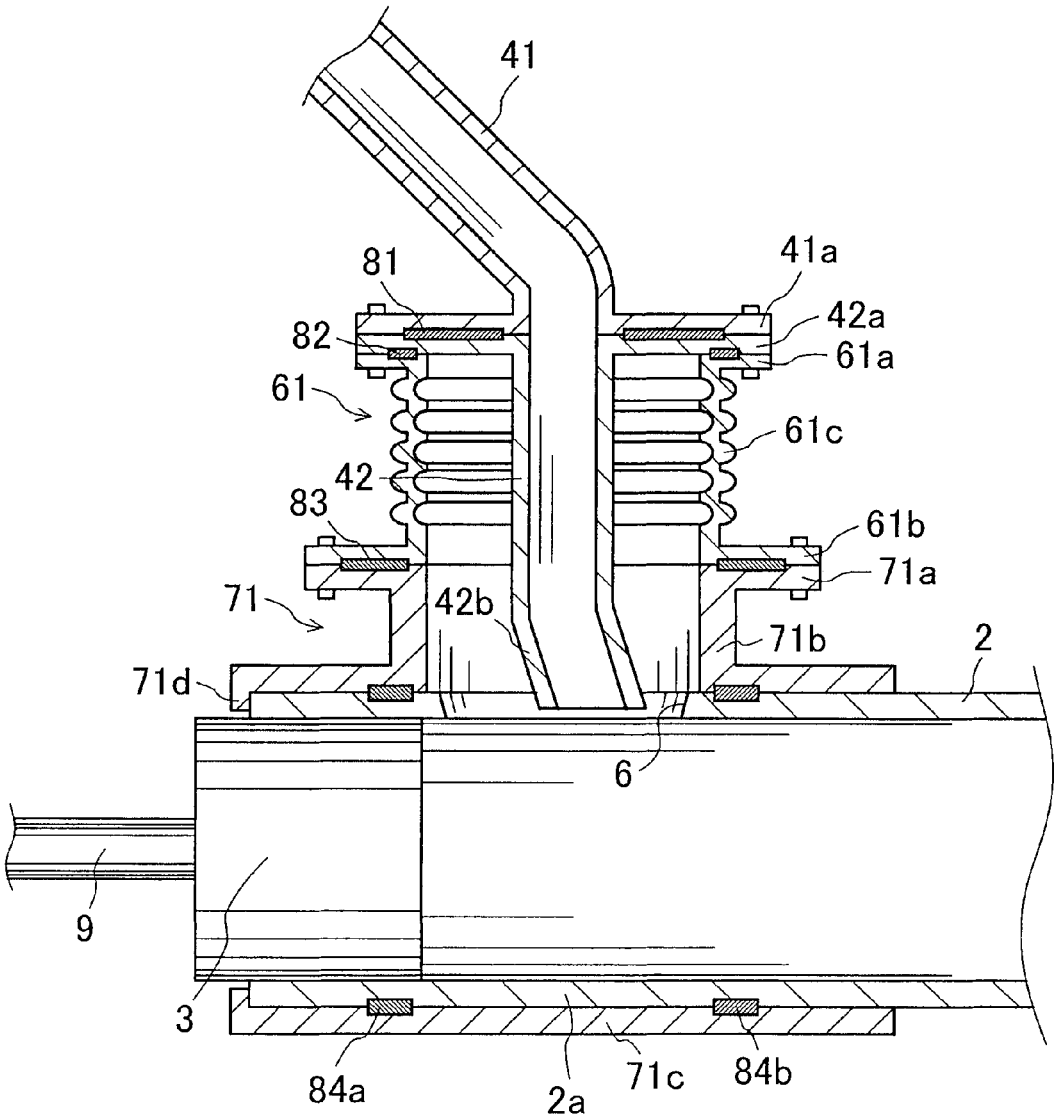
FIG. 2 is an enlarged sectional view of the feeding orifice portion of the die casting device.

The support structure of the feeding pipe 41, 42 by the relay pipe 61 will be described in more detail using FIG. 2. The thermal insulation member 71 includes a fixed cylinder 71*c* formed at a portion thereof lower than a tubular portion 71*b*, which is a body portion. The fixed cylinder 71*c* is a cylindrical portion perpendicular to the tubular portion 71*b*. The open end 2*a* of the injection sleeve 2 (the left side end in FIG. 2) can be inserted into the inner circumference of the fixed cylinder 71*c*. In addition, a fixed projecting portion 71*d* is formed at the left end of the fixed cylinder 71*c*, which is one end of the fixed cylinder 71*c*. The fixed projecting portion 71*d* projects radially inwardly. By inserting the left end of the injection sleeve 2 into the fixed cylinder 71*c* until the fixed projecting portion 71*d* abuts the left end face of the open end 2*a*, the position of the thermal insulation member 71 is fixed. Thus, the position of the tubular portion 71*b* of the thermal insulation member 71 accords with the feeding orifice 6. In addition, a flange portion 71*a* is formed outwardly at the upper end of the tubular portion 71*b*.

The relay pipe 61 includes: a bellows 61*c*, which is a tubular bellows structure; an upper flange portion 61*a* formed outwardly at the upper end thereof; and a lower flange portion 61*b* formed outwardly at the lower end thereof. The bellows 61*c* is extendable and bendable, and absorbs deformation and vibration at the upper end or lower end of the relay pipe 61.

The relay pipe 61 and the thermal insulation member 71 are joined by connecting the lower flange portion 61*b* to the flange portion 71*a* of the thermal insulation member 71. In this embodiment, the lower flange portion 61*b* and the flange portion 71*a* of the thermal insulation member 71 are fastened by a bolt and nut. However, such connection method is not restrictive, but other connection means may be used for the connection. In addition, it is possible not to employ the thermal insulation member 71, by forming the lower end of the relay pipe 61 from a material of high thermal insulation properties.

On the other hand, the upper feeding pipe 41 has a connection flange portion 41*a* formed at the lower end thereof and protruding outward. The lower feeding pipe 42 has a connection flange portion 42*a* formed at the upper end thereof and protruding outward. The junction of the upper feeding pipe 41 and the lower feeding pipe 42 is supported by the relay pipe 61 by connecting the connection flange portion 41*a* and the connection flange portion 42*a* to the upper flange portion 61*a* of the relay pipe 61 with connection members such as a bolt and nut in a state that the connection flange portion 41 a and the connection flange portion 42*a* face and abut each other. In this embodiment, the lower end 42*b* of the lower feeding pipe 42, which is the other end of the feeding pipe 41, 42, is bent in the right side direction, which is the injection direction of the molten metal 5.

In addition, in this embodiment, in order to secure sealability for each part, gaskets 81, 82, 83, and 84*a* and 84*b* made of a graphite material are inserted between the connection flange portion 41*a* and the connection flange portion 42*a*, between the connection flange portion 42*a* and the upper flange portion 61*a*, between the lower flange portion 61*b* and the flange portion 71*a*, and between the inner circumference surface of the tubular portion 71*b* and the outer circumference surface of the injection sleeve 2, respectively.

The die casting device 30 according to this embodiment is configured in the above manner. The die casting device 30 conducts casting by conducting an injection action by feeding molten metal 5 into the injection sleeve 2 from the molten-metal holding furnace 50 through the feeding pipe 41, 42 by the electromagnetic pump 40, and pushing out the molten metal 5 in the right side direction by the injection tip 3 to inject the molten metal 5 into the cavity 4 in a state that the inside of the cavity 4 is decompressed by a decompression device.

Figure 3A:
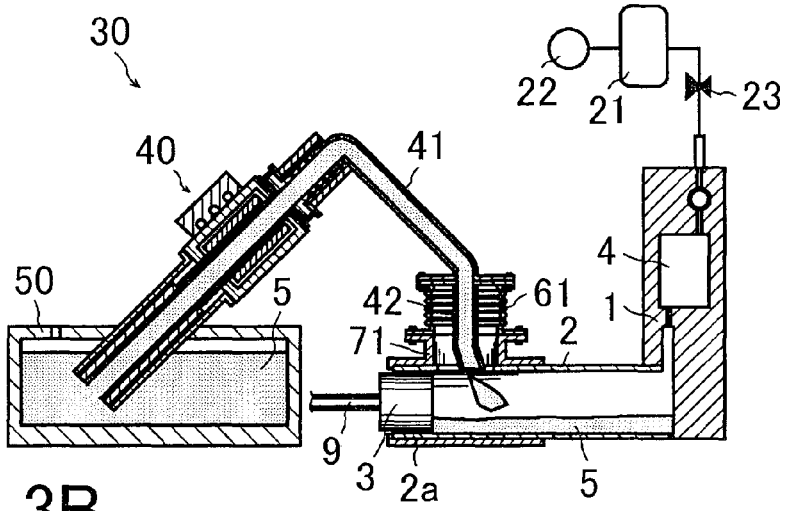
FIG. 3A, FIG. 3B, and FIG. 3C are schematic sectional views of the die casting device at the time of molten-metal feeding, at the time of decompression, and at the time of injection, respectively.

[Vacuum-Casting Process by Die Casting Device 30] Next, a vacuum-casting process by the die casting device 30 is described with reference to FIGS. 3A-3C. Firstly, as shown in FIG. 3A, for feeding molten metal in the die casting device 30, molten metal 5 is pump up by the electromagnetic force of the electromagnetic pump 40, and the molten metal 5 is fed into the injection sleeve 2 from the feeding orifice 6 through the feeding pipe 41, 42. In addition, the distal end of the injection tip 3 at the side in the injection direction is positioned at the left side of the feeding orifice 6 in this figure, to make a state that the feeding orifice 6 is completely opened. In addition, the valve 23 is made into a closed state to deactivate decompression.

Figure 3B:
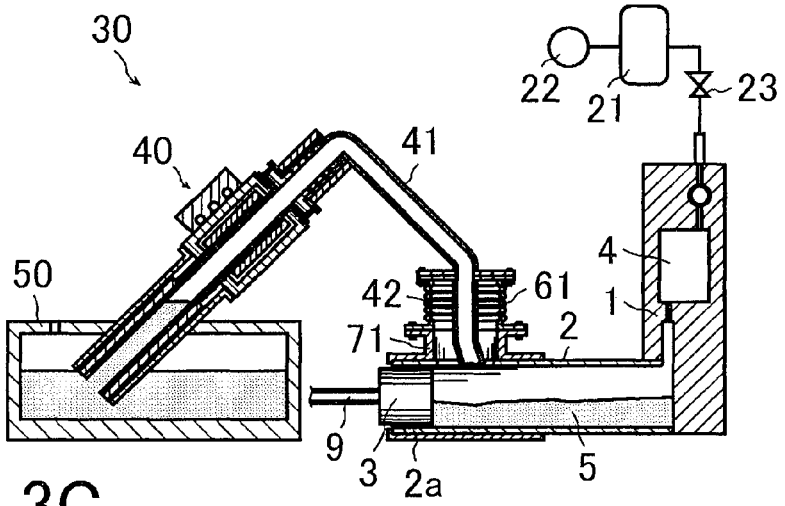

Next, as shown in FIG. 3B, for decompression in the die casting device 30, the valve 23 is opened, and the decompression of the cavity 4 is started.

Figure 3C:
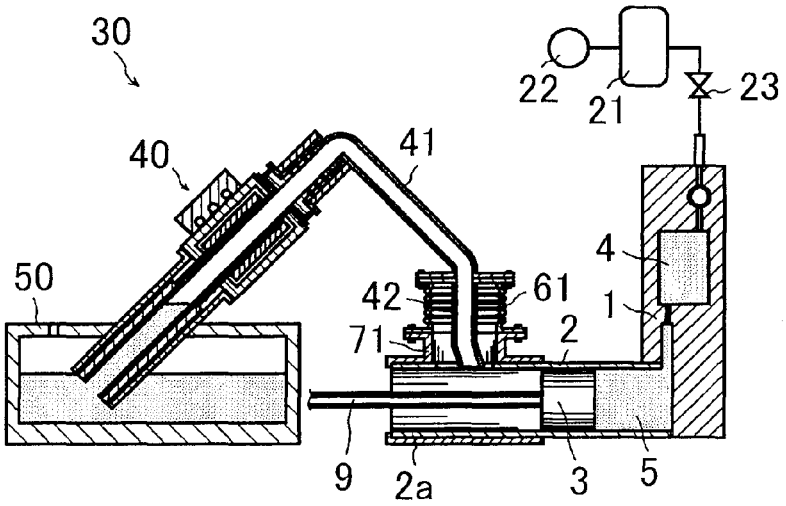

Then, as shown in FIG. 3C, for injection in the die casting device 30, the molten metal 5 is injected by the injection action of the injection tip 3, into the cavity 4, in which a predetermined degree of decompression is being secured. During the above injection, suction of air from the cavity 4 is further continued by opening the valve 23.

In this manner, in a state that air in the cavity 4 is suctioned by the decompression device during the decompression step, the molten metal 5 is injected into the cavity 4 as the injection step. Then, after the injection tip 3 completely moved to the injection side, the valve 23 is closed and it will be in a state that the decompression has been completed. Furthermore, when a product within the cavity 4 has been solidified, the die is opened and the product is taken out.

In addition, after the completion of the injection, the injection tip 3 is retracted to the state shown in FIG. 1. At this time, if there is any scrap of the molten metal 5, rubbish, or the like in the injection sleeve 2, these are pushed back to be removed by the back face of the injection tip 3 (an end face at the side in the retraction direction), and are scraped out from the open end 2*a* of the injection sleeve 2.

In this manner, by the retraction action of the injection tip 3, the inner circumference surface of the injection sleeve 2 can be made into a clean state. Also, by removing rubbish and the like, it is possible to restrain mixing of impurities in a next injection, and eventually to improve the quality.

In the die casting device 30 according to this embodiment, as the feeding amount of molten metal 5 is controlled by the electromagnetic pump 40, it becomes possible to improve the accuracy of feeding molten metal. Specifically, as compared with the configuration that the amount of molten metal to be pumped up is adjusted by a ladle, this embodiment can improve the error rate of molten-metal feeding amount by 2%.

In addition, in the die casting device 30 according to this embodiment, molten metal 5 is fed into the injection sleeve 2 from the molten-metal holding furnace 50 through the electromagnetic pump 40 and the feeding pipe 41, 42 so as to prevent molten metal 5 from exposing to atmosphere at the time of molten-metal feeding. For this reason, this embodiment can prevent temperature reduction of molten metal 5, and deterioration of the product quality due to gas such as dissolved hydrogen and an oxidized film produced in the molten metal 5. Specifically, this embodiment can reduce the difference between the temperature in molten metal 5 in the molten-metal holding furnace 50 and the temperature in molten metal 5 in the feeding orifice 6. In addition, this embodiment can reduce the amount of gas (hydrogen gas and nitrogen gas) within the casted product by several times as compared with a product made by a general die casting device.

Furthermore, in the die casting device 30 according to this embodiment, the feeding pipe 41, 42 is joined to the injection sleeve 2 through the relay pipe 61 having the bellows 61*c*, which is a vibration absorption portion formed to be extendable and bendable. Thereby, it is configured to absorb deformation and vibration in the injection sleeve 2 by the bellows 61*c*.

As described above, even if deformation has been made on the injection sleeve 2 due to heat during use, or vibration is produced by this deformation at the time of injection, this embodiment can absorb deformation and vibration in the injection sleeve 2 by the bellows 61*c*. That is, this embodiment can prevent the feeding pipe 41, 42 and its junction from being damaged by abrasion and vibration at the time of injection.

Furthermore, in the die casting device 30 according to this embodiment, because the feeding pipe 41, 42 is directly joined to the injection sleeve 2, no separate structure for supporting the feeding pipe 41, 42 is required. In addition, because the relay pipe 61 having the bellows 61*c* has a sufficient strength against the heat of molten metal 5 at the time of molten-metal feeding and against pressure at the time of decompression of the cavity 4, the die casting device 30 is not damaged by them.

That is, the die casting device 30 of this embodiment can maintain, with a simple configuration, product quality, the accuracy of molten-metal feeding into the injection sleeve 2, and durability, and it can also reduce the effect of abrasion and vibration at the time of injection.

In addition, in this embodiment, the upper end of the relay pipe 61 is joined to the junction of the upper feeding pipe 41 and the lower feeding pipe 42, which is an intermediate portion of the feeding pipe 41, 42, and the lower end 42*b* of the lower feeding pipe 42, which is the lower end of the feeding pipe 41, 42 is positioned in or near the feeding orifice 6.

In this manner, because the lower end of the feeding pipe 41, 42 extends in or near the feeding orifice 6 of the injection sleeve 2, this embodiment can prevent molten metal 5 from scattering at the time of feeding into the injection sleeve 2. In addition, because the relay pipe 61 does not directly contact molten metal 5, the relay pipe 61 can be protected from the high heat of the molten metal 5.

In addition, in this embodiment, the lower end 42*b* of the lower feeding pipe 42, which is the lower end of the feeding pipe 41, 42, is bent in the right side direction, that is, the injection direction of molten metal 5. Thereby, this embodiment can feed molten metal 5 into the injection sleeve 2 in the same direction as the injection direction (the right side in FIG. 1), and can prevent the molten metal 5 from being scattered.

In addition, in this embodiment, the relay pipe 61 is connected to the injection sleeve 2 through the thermal insulation member 71. Thereby, the present invention can prevent the relay pipe 61 from being exposed to the high heat of the injection sleeve 2, and improve the durability of the relay pipe 61.

In addition, in this embodiment, the molten-metal holding furnace 50 stores molten metal 5 in a state that the molten metal 5 is isolated from the atmosphere. Thereby, the die casting device 30 as a whole prevents the molten metal 5 from being exposed to the atmosphere and can prevent the deterioration in quality of casting products.

The invention claimed is:

1. A die casting device comprising:

a die that includes a cavity;

an injection sleeve that includes a feeding orifice and communicates with the cavity;

a support shaft;

an injection tip provided at a distal end of the support shaft, the injection tip being configured to be slidable in an axial direction within the injection sleeve by inserting the support shaft into the injection sleeve;

a decompression device that communicates with the cavity;

a molten-metal holding furnace that includes a space to store molten metal;

a pump that pumps up the molten metal from the molten-metal holding furnace, wherein the pump is inclined upward away from the molten-metal holding furnace;

a relay pipe that includes a vibration absorption portion; and a feeding pipe including an upper feeding pipe and a lower feeding pipe, a first end of the upper feeding pipe is connected to the pump, a second end of the upper feeding pipe is connected to a first end of the lower feeding pipe, and a second end of the lower feeding pipe communicating with the feeding orifice, the feeding pipe being joined to the injection sleeve through the relay pipe, wherein the upper feeding pipe is inclined downwards toward the injection sleeve, and a portion of the lower feeding pipe passing through the relay pipe is perpendicular to the feeding orifice, wherein the vibration absorption portion is provided on a connection between the second end of the upper feeding pipe and the first end of the lower feeding pipe, wherein the molten metal is fed into the injection sleeve from the molten-metal holding furnace through the feeding pipe by the pump, and the fed molten metal is pushed out of the injection sleeve by the injection tip so that the molten metal is injected into the cavity decompressed by the decompression device.

2. The die casting device according to claim 1, wherein the relay pipe includes a first end joined to an intermediate portion of the feeding pipe that is the connection between the second end of the upper feeding pipe and the first end of the lower feeding pipe, and the second end of the lower feeding pipe is positioned in or near the feeding orifice.

3. The die casting device according to claim 2, wherein the second end of the lower feeding pipe is bent in an injection direction of the molten metal.

4. The die casting device according to claim 1, further comprising a thermal insulation member, wherein the relay pipe is connected to the injection sleeve through the thermal insulation member.

5. The die casting device according to claim 4, wherein the relay pipe includes a second end joined to a first end of the thermal insulation member, and the thermal insulation member includes a second end joined to the injection sleeve.

6. The die casting device according to claim 5, wherein the first end of the thermal insulation member includes a flange portion which connects to a flange at the second end of the relay pipe.

7. The die casting device according to claim 5, wherein the second end of the thermal insulation member includes a tubular portion, a fixed cylinder formed below the tubular portion, and a fixed projecting portion formed at one end of the fixed cylinder and projecting radially inward.

8. The die casting device according to claim 7, wherein the tubular portion of the thermal insulation member is perpendicular to the fixed cylinder of the thermal insulation member, an open end of the injection sleeve is inserted into the fixed cylinder, and the fixed projecting portion abuts an end face of the open end of the injection sleeve.

9. The die casting device according to claim 1, wherein the molten-metal holding furnace is configured to store the molten metal in a state that the molten metal is insulated from an atmosphere.

10. The die casting device according to claim 1, further comprising:

a passage that connects the cavity and the decompression device; and a valve that opens and closes the passage, the valve being provided in the passage;

wherein, in a state that the valve is closed, the molten metal is pumped up from the molten-metal holding furnace by the pump, and in a state that the valve is open and the cavity is decompressed by the decompression device, the fed molten metal is pushed into the cavity by the injection tip.

* * * * *